US005375850A

United States Patent [19]

Pickett

[11] Patent Number: 5,375,850

[45] Date of Patent: Dec. 27, 1994

[54] DART

[76] Inventor: Michael R. Pickett, 2240 Iris Ave., San Diego, Calif. 92154

[21] Appl. No.: 51,922

[22] Filed: Apr. 22, 1993

[51] Int. Cl.[5] ..... A63B 65/02

[52] U.S. Cl. ..... 273/420

[58] Field of Search ..... 273/416, 419–420, 273/423, 421, 422; 403/343

[56] References Cited

U.S. PATENT DOCUMENTS

| | | | |
|---|---|---|---|
| 916,813 | 3/1909 | Whitney . | |
| 3,610,630 | 10/1971 | Glover . | |
| 3,876,319 | 4/1975 | Meyer | 403/343 |
| 4,210,330 | 7/1980 | Kosbab | 273/422 |

FOREIGN PATENT DOCUMENTS

| | | | |
|---|---|---|---|
| 135316 | 11/1949 | Australia . | |
| 731388 | 5/1932 | France | 273/420 |
| 812677 | 5/1937 | France . | |
| 419323 | 11/1934 | United Kingdom . | |
| 506176 | 5/1939 | United Kingdom | 273/420 |
| 506452 | 5/1939 | United Kingdom . | |
| 508709 | 7/1939 | United Kingdom . | |
| 520857 | 5/1940 | United Kingdom | 273/420 |
| 566343 | 12/1944 | United Kingdom | 273/420 |
| 589629 | 6/1947 | United Kingdom | 273/416 |
| 599242 | 3/1948 | United Kingdom . | |

OTHER PUBLICATIONS

*Archery*, Apr. 1978 p. 14, Snuggers.

*Primary Examiner*—Paul E. Shapiro
*Attorney, Agent, or Firm*—Townsend and Townsend Khourie and Crew

[57] ABSTRACT

An improved dart which has a barrel provided with internally threaded ends so that a nose piece and a tailpiece can be threadably coupled to the barrel and be held snugly in place to the barrel. O-ring seals of resilient material are used to hold the nose piece and tailpiece sufficiently tightly to the barrel to prevent the reverse rotation of the nose and tailpieces except by the application of a rotational force. A shaft can extend between the nose and tailpieces in concentric relationship to the barrel so that segmented weights can be placed on the shaft in the barrel, if desired, to enhance the stability and movement of the dart through the air toward a target.

7 Claims, 2 Drawing Sheets

DART

This invention relates to improvements in darts which typically are used in a game of darts and are thrown at a dart board.

BACKGROUND OF THE INVENTION

Many improvements have been made over the years for darts which are adapted to be thrown through the air from a first location to a target location, such as a dart board hung on a vertical wall. For the most part, these improvements have been generally satisfactory to provide more efficient arrangement of parts of the dart to enhance the skills and accuracy of the users of the darts.

Improvements in darts typically center on the distribution of weight as the dart itself remains in a substantially streamlined form. Thus, the dart will encounter less air turbulence or other manifestations of the air which would otherwise adversely affect the trajectory of the dart as it is thrown through the air. The aim, of course, is to have trouble-free movement of the darts so that, as the skills of the user improves, the chances of anticipating greater scoring success increases. Moreover, the interest in the game of darts itself will be enhanced since knowledge of the improvements of the darts will stimulate the user to want to enter and play the game of darts with all comers.

While substantial improvements have been made over the years, there is still room for additional improvements to thereby enhance the skills of the users of the darts and to generate continued interest in the game of darts notwithstanding very long play periods which are characteristic of the game of darts. The present invention satisfies the need for additional improvements as will hereinafter be described.

Disclosures of darts are found in the following patents: FR 812,577; 916,813; 3,610,630; 599,242; 589,629; 508,709; 135,316; 506,452; 419,323.

SUMMARY OF THE INVENTION

The present invention relates to an improved dart which has a barrel provided with internally threaded ends so that a nose piece and a tailpiece can be threadably coupled to the barrel and be held snugly in place to the barrel. O-ring seals of resilient material are used to hold the nose piece and tailpiece sufficiently tightly together to prevent the reverse rotation of the nose and tailpieces except by the application of a rotational force. A shaft can extend between the nose and tailpieces in concentric relationship to the barrel so that segmented weights can be placed in the barrel, if desired, to enhance the stability and movement of the dart through the air toward a target.

Another improvement of the invention is the provision of a shaft which extends through the barrel, the nose piece and the tailpiece, wherein the shaft has a press fitted sleeve thereon for abutment against the front end of the nose piece to avoid having to thread the sleeve on the shaft as conventionally required. The sleeve can also be threadably coupled by a pair of keys to the front of the nose piece while the sleeve remains press fitted on the shaft.

The primary object of the present invention is to provide improvement for a dart, including a barrel which is internally threaded to threadably receive the nose piece and tailpiece of the dart to thereby eliminate the problems associated with stability and accuracy due to connecting the nose piece and tailpiece to the barrel of the dart.

Another object of the present invention is to provide an improved dart of the type described wherein the shaft of the dart has a front sleeve press fitted on the shaft to thereby eliminate the need for an integral attachment between the sleeve and the shaft to thereby permit the sleeve to be directly connected to the nose piece to simplify the assembly of the dart and to allow weights to be placed upon the shaft in the barrel.

Other objects of the present invention will become apparent as the following specification progresses, reference being had to the accompanying drawings for an illustration of the invention.

DETAILED DESCRIPTION OF THE PREFERRED EMBODIMENT

Figure 1:
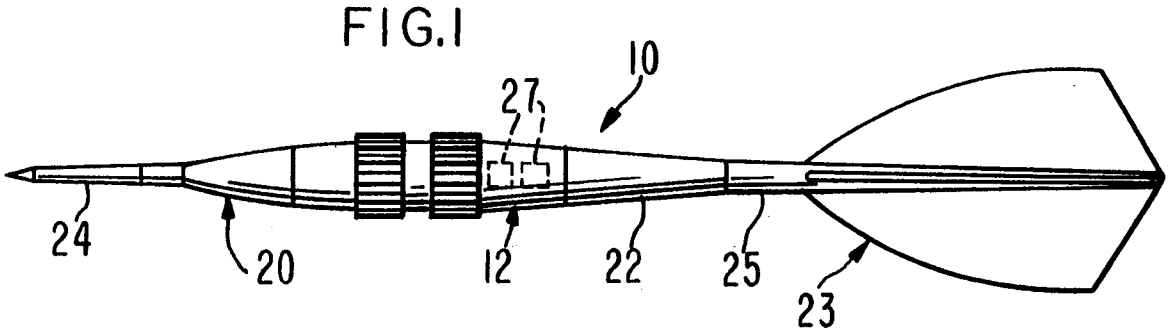
FIG. 1 is a side elevational view of a conventional dart whose stability and design characteristics are enhanced by the improvements of the present invention.

A dart is shown in FIG. 1 and is broadly denoted by the numeral 10. It includes a barrel 12 which extends from a nose piece 20 to a tailpiece 22. A pointed pin-like member 24 forms part of a shaft (not shown) which extends through nose piece 20, barrel 12 and into tailpiece 22. A fin assembly 23 has a neck 25 which is threadably coupled to the rear end of tailpiece 22.

One or more weights 27 shown in dashed lines in FIG. 1 can be slidably mounted on the central part of the shaft within barrel 12. The arrangement of weights is typically selected by the individual who supplies the dart for competition and other activities. The weight values of the weights are typically in the range of 10 to 20 grams but this range can be wider or narrower, if desired.

The foregoing description relates to a dart which has various parts as hereinafter described as being new and patentable. Dart 10 will be set forth and described with respect to the parts of darts shown in FIGS. 2–8.

Figure 7:
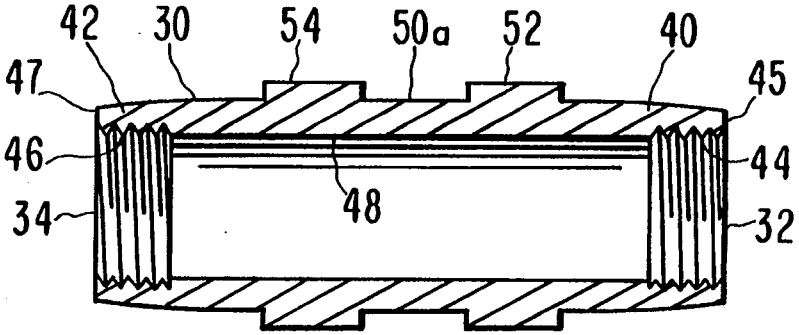
FIG. 7 is a vertical section through the barrel showing the internal threaded portions at the ends thereof.

A first improvement of the present invention is shown in FIG. 7 and includes a barrel 30 for a dart of the type shown in FIG. 1. Barrel 30 has a generally cylindrical shape and is open at ends 32 and 34 thereof. The inner wall surfaces 40 and 42 at the respective ends of barrel 30 are provided with annular thread means 44 and 46 and the rest of the interior of the barrel is cylindrical in shape to present a cylindrical inner surface 48 (FIG. 7). The outer surface 50a of barrel 30 has annular knurled surface enlargements 52 and 54 which facilitate the manual rotation of the dart when the dart is to be separated into parts.

The barrel 30 has end faces 45 and 47, respectively. The threaded means 44 and 46 extend to the outer end faces 45 and 47, respectively.

Threaded means 44 and 46 are provided to threadably mount a nose piece and a tailpiece, respectively to barrel 30. Nose piece 50 shown in FIG. 8 has a conical body 52 having a forward end 54 provided with an internally threaded bore 55 for threadably receiving the rear end 56 of a shaft segment 58 which has a pointed forward end 60. Nose piece 50 has a rear, annular projection 62 which is externally threaded by thread means 63 for threading into the thread means 44 of barrel 30 as shown in FIG. 7. An 0-ring seal 66 is mounted on annular externally threaded projection 62 at a location near the rear face 68 of conical body 52. A hole 70 is provided in body 52 for receiving a tool for using the hole 70 as a fulcrum for rotating nose piece 50 into place on barrel 30. The 0-ring serves to provide a means to prevent reverse rotation of the nose piece 50 on barrel 30 so that the nose piece will remain tightly connected to the barrel substantially at all times until it is to be replaced or otherwise separated from the barrel.

Figure 8:
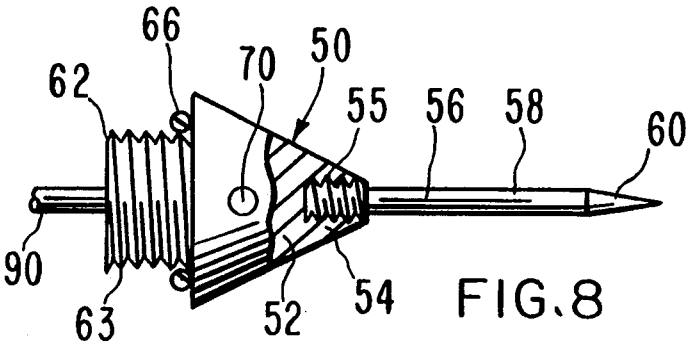
FIG. 8 is a side elevational view of a nose piece of the present invention.
Figure 5:
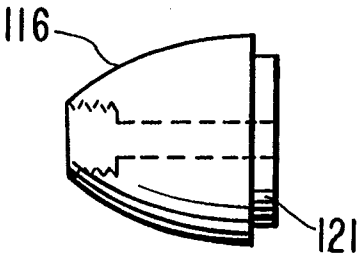
Figure 7A:
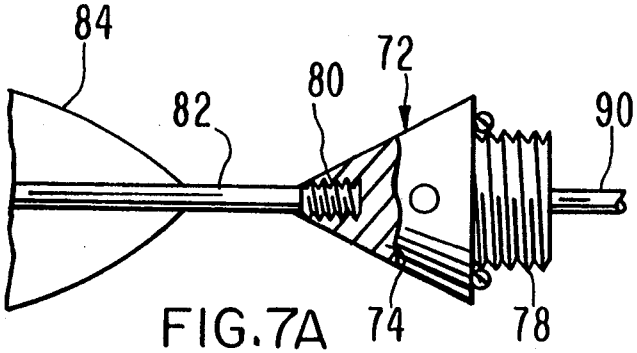
FIG. 7A is a side elevational view of a tailpiece.

As shown in FIG. 7A, a tailpiece 72 is adapted to be threaded into the rear open end 34 of barrel 30, the tailpiece 72 having a conical body 74 which can have the same or different shape from body 52 of nose piece 50 of FIG. 8. To this end, body 74 of tailpiece 72 has a conical outer surface and a threaded projection 78 threaded into thread means 46 at the rear open end of barrel 30. The rear portion of body 74 has an internally threaded bore 80 for receiving a shaft segment 82 on which vane means 84 is mounted for stability purposes.

In use, nose piece 50 and tailpiece 72 are threadably mounted on the respective ends of barrel 30. The barrel may have a shaft 90 which extends between the nose piece and tailpiece so that one or more weights can be mounted on the shaft, if desired. Typically, the weights are segmented so that the desired amount of weight can be evenly distributed in any suitable fashion along the length of the shaft. The shaft, if used, is secured in any suitable manner, such as by threads, to the inner ends of nose piece 50 and tailpiece 72.

With the dart shown with barrel 30, nose piece 50 and tailpiece 72 coupled together, the dart can be thrown through the air and its stability and weight distribution will propel it toward the target which is typically a dart board mounted on a vertical wall. The weight distribution can be changed by removing tailpiece 74 from the barrel, adding or taking off weights from the shaft 90 and replacing the tailpiece 74 on the barrel.

As a second improvement, a dart 100 has a barrel 102 (FIG. 2) and the barrel has a pair of open ends which are not threaded but which have end faces 104 and 106. A nose piece 108 has a rear face which butts up against front face 108 of barrel 102. Likewise, a rear or tailpiece 110 butts up against, at its forward end face, the rear end face 106 of barrel 102. An O-ring seal 112 is at the junction of barrel 102 and tailpiece 110 for the same reason as that provided by O-ring seal 66 of nose piece 50, as shown in FIG. 8.

A shaft 116*d* has a sleeve 118 press fitted thereon, the shaft extending forwardly by means of a segment 120 with a pointed front end 122. The press fit of sleeve 118 on shaft 116*d* eliminates the need for threaded means for coupling the shaft to the sleeve.

Figure 3:
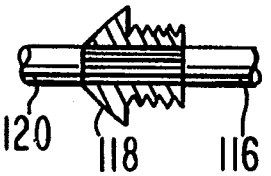
FIG. 3 is a vertical section through the shaft and the press-fitted sleeve on the shaft for avoiding the need for a threaded attachment between the shaft and nose piece.

Sleeve 118 has thread means 123 thereon for threadably mounting the sleeve on the nose piece 118 when the sleeve 118 is press fitted on the shaft 116*d*. Thus, by virtue of the press fit of sleeve 118 on the shaft 116, the sleeve will serve as a stop for the nose piece 118 when the nose piece is threaded onto the annular rear body portion of the sleeve 118. FIG. 3 has sleeve 118 thereof as being convex or conical and converging toward the shaft as the forward end of the sleeve is approached.

Figure 4:
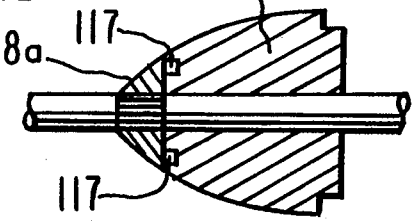
FIG. 4 is a view of another embodiment of the nose piece of the present invention, the nose piece using a attachment having keys for coupling the corresponding shaft to the front end of the barrel.
Figure 6:
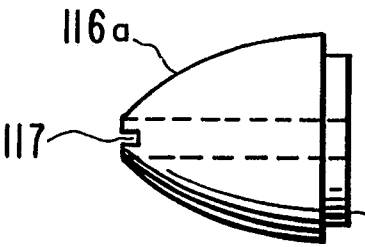
FIGS. 5 and 6 show enlarged versions of the nose pieces shown in FIGS. 3 and 4.

In FIG. 4, the sleeve 118*a* is substantially the same general construction as sleeve 118 (FIG. 3) except that sleeve 118*a* (FIG. 4) has a generally conical or convex outer surface. Also, sleeve 118*a* in FIG. 4 held by a pair of keys 117 which operate in bayonet fashion to lock the shaft to the corresponding nose piece 116*a* by virtue of connecting links connecting the shaft with the keys as the sleeve 118 remains press fitted on the shaft 106. Nose pieces 116 and 116*a* have annular projections 121 (FIG. 5) which fit into the front end of the barrel to position the nose piece for attachment to the barrel itself by the shaft 116*d*. The nose piece shown in FIG. 4 and the nose piece shown in FIG. 6 are shown in more detail separated from the barrel in FIGS. 7 and 8.

The tailpiece for dart 100 is broadly denoted by the numeral 130 and includes a tailpiece 110 having a body 132 which is generally conical or convex and extends rearwardly of barrel 102. A rear bore 134 threadably receives a shaft segment 136 on which vanes 138 are mounted for stability purposes. The front face 140 of tailpiece 110 has a bore which is internally threaded and denoted by the numeral 142. The rear end of shaft 116 is threaded for threadable attachment into bore 142 to complete the assembly of the dart 100.

Figure 2:
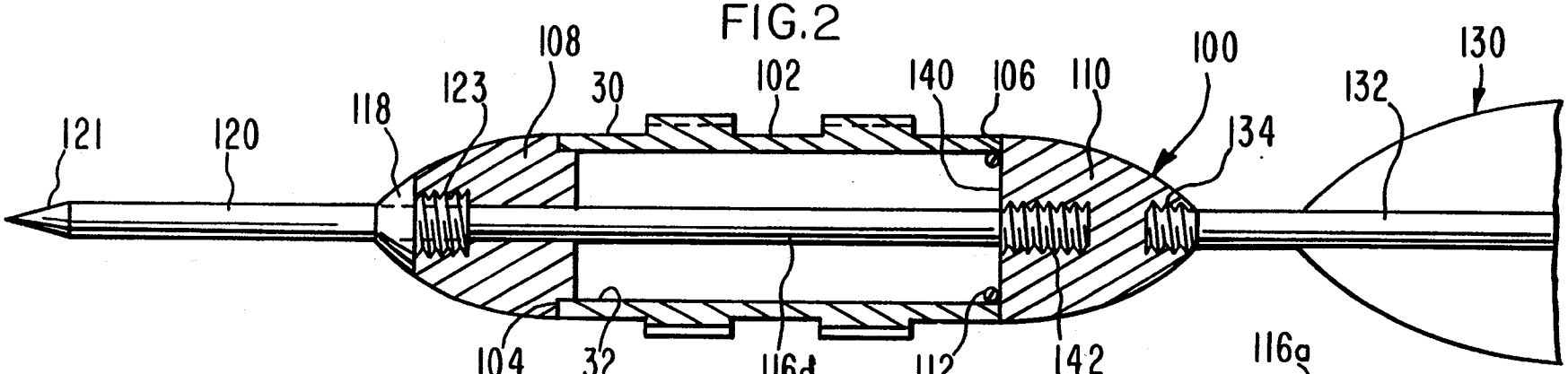
FIG. 2 is a view similar to FIG. 1 but schematically showing a threaded nose piece on the front end of an internally threaded barrel, and further showing a shaft extending through the barrel and being threadably coupled at the end thereof for threadable coupling with a tailpiece.

In use, the dart is thrown through the air fully assembled in the manner shown in FIG. 2. The dart is typically thrown toward a target which is hanging on a vertical wall. The dart shaft 116*d* associated with barrel 102 can be provided with one or more weight members in the barrel and on the shaft, and these weights can be adjustably placed on or taken off the shaft after tailpiece 110 is separated from the shaft 116 by unthreading the tailpiece from the rear end of the shaft.

I claim:

1. A dart comprising:

a tubular barrel having a pair of opposed open ends;

a nose piece at the front end of the barrel for closing the barrel;

a tailpiece at the rear end of the barrel;

a shaft having a guide sleeve press fitted thereon, said guide sleeve having a rear part threadably coupled into the front part of the nose piece, said shaft extending from a location forwardly of the sleeve through the barrel and at least to a location in said tailpiece at the rear end; and vane means coupled to the tailpiece to provide stability for the barrel as the barrel is thrown through the air.

2. In a dart as set forth in claim 1, wherein the sleeve is press fitted on the shaft, the shaft being threadably coupled to the nose piece.

3. In a dart as set forth in claim 1, wherein each end of the barrel is provided with an annular, axially extending inner peripheral face, said nose piece having an outer peripheral, annular end face for engaging the adjacent end face of the barrel.

4. In a dart as set forth in claim 1, wherein the nose piece has a conical forward end face.

5. In a dart as set forth in claim 1, wherein said sleeve has a convex outer face.

6. In a dart as set forth in claim 1, wherein is included key means for coupling the sleeve to the shaft.

7. In a dart as set forth in claim 1, wherein the interior of the barrel is of a size sufficient to accommodate at least one weight member.

* * * * *